US009776027B2

(12) United States Patent
Lin et al.

(10) Patent No.: US 9,776,027 B2
(45) Date of Patent: Oct. 3, 2017

(54) UNIDIRECTIONAL, SPRINKLER-TYPE, ANTIPERSONNEL-FRAGMENTATION-FREE FIRE-EXTINGUISHING BOMB

(71) Applicant: BEIJING MECHANICAL EQUIPMENT INSTITUTE, Beijing (CN)

(72) Inventors: Xiaodi Lin, Beijing (CN); Shuyong Han, Beijing (CN); Aifeng Chen, Beijing (CN); Hao Liu, Beijing (CN); Xuyang Qiu, Beijing (CN); Wen Ding, Beijing (CN); Hejiu Wang, Beijing (CN)

(73) Assignee: Beijing Mechanical Equipment Institute, Beijing (CN)

( * ) Notice: Subject to any disclaimer, the term of this patent is extended or adjusted under 35 U.S.C. 154(b) by 5 days.

(21) Appl. No.: 14/405,588

(22) PCT Filed: Jul. 12, 2013

(86) PCT No.: PCT/CN2013/079324
§ 371 (c)(1),
(2) Date: Dec. 4, 2014

(87) PCT Pub. No.: WO2014/019449
PCT Pub. Date: Feb. 6, 2014

(65) Prior Publication Data

US 2015/0231429 A1 Aug. 20, 2015

(30) Foreign Application Priority Data

Aug. 2, 2012 (CN) ..... 2012 1 0272992

(51) Int. Cl.
*A62C 8/00* (2006.01)
*A62C 19/00* (2006.01)
*F42B 12/46* (2006.01)

(52) U.S. Cl.
CPC ..... *A62C 19/00* (2013.01); *F42B 12/46* (2013.01)

(58) Field of Classification Search
CPC ..... A62C 35/68; A62C 35/60; A62C 99/0018; A62C 3/16; A62C 31/02; A62C 35/62;
(Continued)

(56) References Cited

U.S. PATENT DOCUMENTS 2,703,527 A * 3/1955 Hansen ..... F42B 12/50 102/365
3,630,412 A 12/1971 Capener et al.
(Continued)

FOREIGN PATENT DOCUMENTS

CN 201177486 Y 1/2009
CN 201192546 Y 2/2009
(Continued)

OTHER PUBLICATIONS

International Search Report From PCT/CN2013/079324, dated Oct. 17, 2013.
(Continued)

*Primary Examiner* — Christopher Kim
*Assistant Examiner* — Adam J Rogers
(74) *Attorney, Agent, or Firm* — Calfee, Halter & Griswold LLP

(57) ABSTRACT

The invention discloses a unidirectional spray type fire extinguishing bomb without high explosive fragmentation, includes a housing, a fuse, an igniter, an fire extinguishing agent and a main charge, and further includes a tail braking device, combustor, a plate closure, a piston and a diffuser. The housing, the tail braking device and the piston are made of light metal materials; the housing is cylindrical; the tail braking device is arranged at the bottom of the housing and is fixed with the housing through a screw nail; and the fuse
(Continued)

is arranged on the diffuser and is fixed through a screw nail. During working process, when the fuse detects the fire extinguishing bomb to be 5-10 meters far away from a combustion source, the igniter ignites the main charge, the piston is pushed under high pressure to move in the housing, and the fire extinguishing agent is sprayed out from spraying holes to the combustion source for fire extinguishing. The present invention has simple structure, and has no lethality when the fire extinguishing agent is sprayed.

2 Claims, 1 Drawing Sheet

(58) Field of Classification Search
CPC ..... A62C 37/11; A62C 37/14; A62C 37/44; A62C 3/07; A62C 3/08; A62C 37/04; A62C 37/40; A62C 3/0214; A62C 99/009; A62C 35/023; A62C 37/50; A62C 3/002
USPC ..... 169/36, 30, 84, 74, 73, 53, 33; 239/171
See application file for complete search history.

(56) References Cited

U.S. PATENT DOCUMENTS

| | | | | |
|---|---|---|---|---|
| 4,372,215 | A * | 2/1983 | Crepin | B64D 1/04 102/387 |
| 4,418,623 | A * | 12/1983 | Gauchard | 102/369 |
| 5,660,236 | A * | 8/1997 | Sears et al. | 169/72 |
| 6,470,805 | B1 * | 10/2002 | Woodall | A62C 3/025 102/370 |
| 7,121,353 | B2 * | 10/2006 | Setzer | 169/28 |
| 7,478,680 | B2 * | 1/2009 | Sridharan | A62C 3/025 102/368 |
| 2005/0139363 | A1 * | 6/2005 | Thomas | 169/30 |
| 2007/0007021 | A1 * | 1/2007 | Regan | 169/84 |
| 2010/0126740 | A1 * | 5/2010 | Hartmann et al. | 169/70 |
| 2012/0085556 | A1 * | 4/2012 | Cox | A62C 5/006 169/46 |

FOREIGN PATENT DOCUMENTS

| | | | |
|---|---|---|---|
| CN | 201445722 | U | 5/2010 |
| CN | 101814133 | A | 8/2010 |
| CN | 102319494 | A | 1/2012 |
| CN | 102423519 | A | 4/2012 |
| CN | 102580278 | A | 7/2012 |
| CN | 102772865 | A | 11/2012 |
| CN | 102880161 | A | 1/2013 |
| CN | 103112385 | A | 5/2013 |
| CN | 103177522 | U | 6/2013 |
| JP | 0975472 | A | 3/1997 |
| JP | 09139870 | A | 5/1997 |
| JP | 11126287 | A | 5/1999 |
| JP | 2003144572 | A | 5/2003 |
| KR | 101039059 | B1 | 6/2011 |
| KR | 20120011378 | A | 2/2012 |
| RU | 2066439 | C1 | 10/1996 |
| WO | 2015/006915 | | 1/2015 |
| WO | 2015/006916 | | 1/2015 |
| WO | 2015/006917 | | 1/2015 |

OTHER PUBLICATIONS

International Search Report from PCT/CN2013/079451 dated May 16, 2014.
International Search Report from PCT/CN2013/079454 dated Apr. 24, 2014.
International Search Report from PCT/CN2013/079455 dated Apr. 24, 2014.
Decision to Grant from European Application No. 13825443.8 dated Aug. 19, 2016.
Search Report from European Application No. 13825443.8 dated Jun. 30, 2015.
Notice of Allowance from Japanese Patent Application No. 2014556918 dated Mar. 15, 2016.
Office Action from Japanese Patent Application No. 2014556918 dated Oct. 27, 2015.
Notice of Allowance from Chinese Application No. 201210272992.4 dated Aug. 5, 2014.
Office Action from Chinese Application No. 201210272992.4 dated May 6, 2014.
Search Results from Chinese Application No. 201210272992.4 dated Aug. 2, 2012.

* cited by examiner

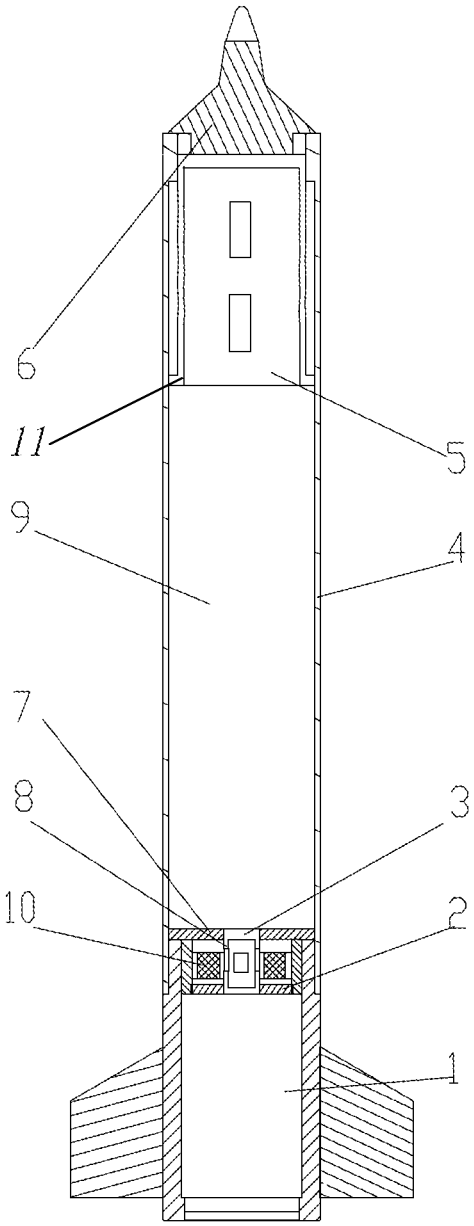
6
11
5
9
4
7
8
3
10
2
1

UNIDIRECTIONAL, SPRINKLER-TYPE, ANTIPERSONNEL-FRAGMENTATION-FREE FIRE-EXTINGUISHING BOMB

TECHNICAL FIELD

The present invention relates to a fire extinguishing bomb, especially to a unidirectional spray type fire extinguishing bomb without high explosive fragmentation.

BACKGROUND

At present, the existing fire extinguishing bombs at home and abroad all take the manner of tube bursting in the middle. In general, the existing fire extinguishing bomb includes a housing, a fuse, a fire extinguishing agent, a main charge, and an igniter; the fire extinguishing agent is pushed to spray by the shock wave produced during the explosion; a lot of high explosive fragmentations with a certain destructive effect are produced while spraying the fire extinguishing agent; this kind of fire extinguishing bombs are suitable for forests, oil tanks, etc. that are far away from densely populated areas, but are not suitable for the fire extinguishing of high-rise buildings and super high-rise buildings under the condition of urban environment.

SUMMARY

The object of the present invention is to provide a unidirectional spray type fire extinguishing bomb without high explosive fragmentation to address the problem that the existing fire extinguishing bombs have high explosive fragmentations and are easy to cause big damage.

A unidirectional spray type fire extinguishing bomb without high explosive fragmentation, includes a housing, a fuse, an igniter, a fire extinguishing agent and a main charge, and further includes a tail braking device, combustor, a plate closure, a piston and a diffuser.

The housing, the tail braking device and the piston are made of light metal materials; the housing is cylindrical; the tail braking device is arranged at the bottom of the housing and is fixed with the housing through a screw nail; the plate closure is arranged above the tail braking device; the combustor is arranged above the plate closure and is fixed with the plate closure screwedly; the combustor is fixed with the housing via a screw nail; the piston is arranged on the combustor; the outer diameter of the piston mates with the inner diameter of the housing; the piston has a through hole at the center; the igniter is arranged within the through hole of the piston and is fixed with the combustor screwedly; the main charge is arranged within the combustor; the fire extinguishing agent is arranged within the cavity on the upper portion of the piston and fills up the entire cavity; the diffuser is arranged at the top of the housing and is fixed with the housing through a screw nail; the diffuser has spraying holes on the surface; and the fuse is arranged on the diffuser and is fixed through a screw nail.

During working process of a unidirectional spray type fire extinguishing bomb without high explosive fragmentation, when the fuse detects that the fire extinguishing bomb is 5-10 meters far away from a combustion source, it sends an ignition signal to the igniter, then the igniter ignites the main charge within the combustor, the main charge generates high pressure when combusting, the piston is pushed under high pressure to move in the housing, the extrusion to the fire extinguishing agent causes a pin connected between the diffuser and the housing to be sheared, the fire extinguishing agent continues to push the diffuser to move forward, the diffuser is braked when reaching the front end of the housing, at that time the spraying holes have already been exposed to the air, while then the piston continues to push the fire extinguishing agent to move forward, the fire extinguishing agent is sprayed out from the spraying holes to the combustion source for fire extinguishing. During the flight spraying process of the fire extinguishing bomb, the tail braking device opens a parachute to make the fire extinguishing bomb decelerate, the fire extinguishing bomb penetrates the glass curtain wall, and goes deep into the building to implement fire extinguishing.

The apparatus of the present invention has simple structure, has no lethality when the fire extinguishing agent is sprayed. And it is suitable for fire extinguishing of high-rise buildings, and also can be used for putting out a fire on the facade of the high-rise buildings.

BRIEF DESCRIPTION OF THE DRAWINGS

FIG. 1 is a schematic diagram of a unidirectional spray type fire extinguishing bomb without high explosive fragmentation.

1. tail braking device 2. plate closure 3. igniter 4. housing 5. diffuser 6. fuse 7. piston 8. combustor 9. fire extinguishing agent 10. main charge

DETAILED DESCRIPTION

A unidirectional spray type fire extinguishing bomb without high explosive fragmentation includes a housing 4, a fuse 6, an igniter 3, a fire extinguishing agent 9 and a main charge 10, and further includes a tail braking device 1, combustor 8, a plate closure 2, a piston 7 and a diffuser 5.

The housing 4, the tail braking device 1 and the piston 7 are made of light metal materials; the housing 4 is cylindrical; the tail braking device 1 is arranged at the bottom of the housing 4 and is fixed with the housing 4 through a screw nail; the plate closure 2 is arranged above the tail braking device 1; the combustor 8 is arranged above the plate closure 2 and is fixed with the plate closure 2 screwedly; the combustor 8 is fixed with the housing 4 via a screw nail; the piston 7 is arranged on the combustor 8; the outer diameter of the piston 7 mates with the inner diameter of the housing 4; the piston 7 has a through hole at the center; the igniter 3 is arranged within the through hole of the piston 7 and is fixed with the combustor 8 screwedly; the main charge 10 is arranged within the combustor 8; the fire extinguishing agent 9 is arranged within the cavity on the upper portion of the piston 7 and fills up the entire cavity; the diffuser 5 is arranged at the top of the housing 4 and is fixed with the housing 4 through a screw nail; the diffuser 5 has spraying holes on the surface; and the fuse 6 is arranged on the diffuser 5 and is fixed through a screw nail;

During working process of a unidirectional spray type fire extinguishing bomb without high explosive fragmentation, when the fuse 6 detects the fire extinguishing bomb to be 5-10 meters far away from a combustion source, it sends an ignition signal to the igniter 3, the igniter 3 ignites the main charge 10 within the combustor 8, the main charge 10 generates high pressure when combusting, the piston 7 is pushed under high pressure to move in the housing 4, the extrusion to the fire extinguishing agent 9 causes a pin 11 connected between the diffuser 5 and the housing 4 to be sheared, the fire extinguishing agent 9 continues to push the diffuser 5 to move forward, the diffuser 5 is braked when reaching the front end of the housing 4, at that time the spraying holes have already been exposed to the air, while then the piston 7 continues to push the fire extinguishing agent 9 to move forward, the fire extinguishing agent 9 is sprayed out from the spraying holes to the combustion source for fire extinguishing; during the flight spraying process of the fire extinguishing bomb, the tail braking device 1 opens a parachute to make the fire extinguishing bomb decelerate, the fire extinguishing bomb penetrates the glass curtain wall, and goes deep into the building to implement fire extinguishing.

The invention claimed is:

1. A unidirectional spray type fire extinguishing bomb, comprising:

a cylindrical housing defining a cavity thereto, and having a first end and a second end, a tail braking device disposed within the housing and at the first end of the housing and coupled with the housing by a fastener, a plate closure disposed within the housing, between the tail braking device and the second end, a combustor disposed within the housing, between the plate closure and the second end, wherein the combustor is coupled with the plate closure by a threaded connection, and is coupled with the housing by a fastener, a piston disposed within the housing, between the combustor and the second end, and defining a through hole at a center, wherein an outer diameter of the piston matches an inner diameter of the housing, an igniter disposed within the through hole of the piston and coupled with the combustor by a threaded connection, a main charge disposed within the combustor, wherein the main charge is configured to be ignite by the igniter, a fire extinguishing agent disposed within the housing, between the piston and the second end, a diffuser having spraying holes disposed on the its surfaced, the diffuser being disposed within the housing and at the second end of the housing, wherein a pin secures the diffuser in a position such that the spraying holes are covered by the housing, wherein upon igniting the main charge, the pin is shorn and the diffuser moves to extend the spraying holes beyond the second end of the housing, and wherein the second end prevents the diffuser from existing the housing, a fuse disposed on the diffuser and coupled with the diffuser by a fastener, wherein the housing, the tail braking device, and the piston are made of light metal materials.

2. The fire extinguishing bomb of claim 1 wherein the fastener is a screw nail.

* * * * *